United States Patent [19]

MacFarlane

[11] Patent Number: 4,788,837

[45] Date of Patent: Dec. 6, 1988

[54] HASP-TYPE LATCH WITH COMBINATION LOCK

[75] Inventor: Walter J. MacFarlane, Kensington, Conn.

[73] Assignee: The Stanley Works, New Britain, Conn.

[21] Appl. No.: 164,439

[22] Filed: Mar. 4, 1988

Related U.S. Application Data

[63] Continuation-in-part of Ser. No. 16,273, Feb. 19, 1987.

[51] Int. Cl.[4] ..... E05B 65/48

[52] U.S. Cl. ..... 70/3; 70/5

[58] Field of Search ..... 70/2, 3, 5, 68, 11–13, 70/72, 73, 74, 76; 292/281, 285, 286

[56] References Cited

U.S. PATENT DOCUMENTS

| | | | |
|---|---|---|---|
| 58,091 | 9/1866 | Fox . | |
| 162,486 | 4/1875 | McConway . | |
| 404,080 | 5/1889 | Frost . | |
| 447,057 | 2/1891 | Krieger | 70/73 |
| 511,933 | 1/1894 | Cottier . | |
| 564,515 | 7/1896 | Glover | 70/13 |
| 597,712 | 1/1898 | Eldridge . | |
| 682,657 | 9/1901 | Wirt . | |
| 906,528 | 12/1908 | Hulbert . | |
| 943,401 | 12/1909 | Ehemann . | |
| 1,141,542 | 6/1915 | Hart . | |
| 1,195,493 | 8/1916 | Nedrow . | |
| 1,335,959 | 4/1920 | Flagg . | |
| 1,508,384 | 9/1924 | Drake . | |
| 1,522,998 | 1/1925 | Buerger et al. . | |
| 1,574,348 | 2/1926 | Hager . | |
| 1,802,741 | 4/1931 | Stephens . | |
| 1,890,912 | 12/1932 | Momm . | |
| 1,938,258 | 12/1933 | Luneburg . | |
| 1,992,734 | 2/1935 | Bittorf . | |
| 2,046,078 | 6/1936 | Marshall . | |
| 2,067,255 | 1/1937 | Bittorf . | |
| 2,267,374 | 12/1941 | Eber . | |
| 2,314,180 | 3/1943 | Thiele . | |
| 2,325,914 | 8/1943 | Moberg . | |
| 2,332,239 | 10/1943 | Lalonde | 70/74 |
| 2,428,207 | 9/1947 | Dzurinda . | |
| 2,430,311 | 11/1947 | Thiele . | |
| 2,442,688 | 6/1948 | Hendlin | 70/5 |
| 2,520,742 | 8/1950 | Soref et al. . | |
| 3,008,321 | 11/1961 | Gonzalez | 70/74 |
| 3,416,338 | 12/1968 | Gehrie . | |
| 3,476,429 | 11/1969 | Foote . | |
| 3,527,070 | 9/1970 | Sato . | |
| 3,707,861 | 1/1973 | Lindner . | |
| 3,787,082 | 1/1974 | Foote . | |
| 3,831,989 | 8/1974 | Gurzenda . | |

(List continued on next page.)

FOREIGN PATENT DOCUMENTS

| | | | |
|---|---|---|---|
| 13039 | 5/1914 | United Kingdom | 70/5 |
| 279611 | 11/1927 | United Kingdom . | |
| 311036 | 5/1929 | United Kingdom . | |
| 314408 | 6/1929 | United Kingdom . | |

OTHER PUBLICATIONS

Photographs of the Alliance Tool Company, HASP Structure.

*Primary Examiner*—Lloyd A. Gall

[57] ABSTRACT

A hasp-type includes a hasp member with a base having a latch leaf is pivotally mounted thereon and has an aperture adjacent its free end. The staple member has a base with a top wall and a depending sidewall defining a cavity thereunder, and the top wall has an opening therethrough. A post member has a pedestal portion which extends through the opening into the cavity of the staple base, and a post portion which extends upwardly through the aperture in the arm in its closed position. The post member has an enlarged portion about its periphery and is rotatable to locate its elongate axis so that it overlies a portion of the latch leaf in the closed position and prevents its being pivoted upwardly. The post member includes a manipulatable releasable latch element engageable with the staple member in its latching position, and a combination lock on the post member precludes disengagement of the latch element when it is locked.

6 Claims, 2 Drawing Sheets

U.S. PATENT DOCUMENTS 3,845,644 11/1974 Lindner .
3,942,344 3/1976 Gehrie et al. .
4,031,723 6/1977 Samhammer et al. ..... 70/68
4,079,974 3/1978 Roper .
4,100,775 7/1978 Bako .
4,168,616 9/1979 Goldman .
4,259,856 4/1981 Wingert .
4,267,716 5/1981 Milles .
4,279,136 7/1981 Milles .
4,290,286 9/1981 Rae .
4,308,731 1/1982 Remington .
4,318,287 3/1982 Remington et al. .
4,324,120 4/1982 Gisiger .
4,327,566 5/1982 Ling .
4,341,101 7/1982 Bako .
4,343,163 8/1982 Scelba et al. .
4,348,878 9/1982 Chang .
4,354,366 10/1982 Bako .
4,355,524 10/1982 Bako .
4,366,684 1/1983 Bako et al. .
4,366,685 1/1983 Remington .
4,366,686 1/1983 Remington et al. .
4,366,687 1/1983 Atkinson .
4,383,425 5/1983 Orabona .
4,389,863 6/1983 Bako .
4,395,892 8/1983 Remington .
4,403,799 9/1983 Kafka et al. .
4,420,953 12/1983 Remington .
4,420,956 12/1983 Li .
4,441,346 4/1984 Castiglioni .
4,450,698 5/1984 Scelba .
4,462,232 7/1984 Yang .
4,467,628 8/1984 Zampini, Jr. .
4,487,043 12/1984 Milles .

FIG. 1
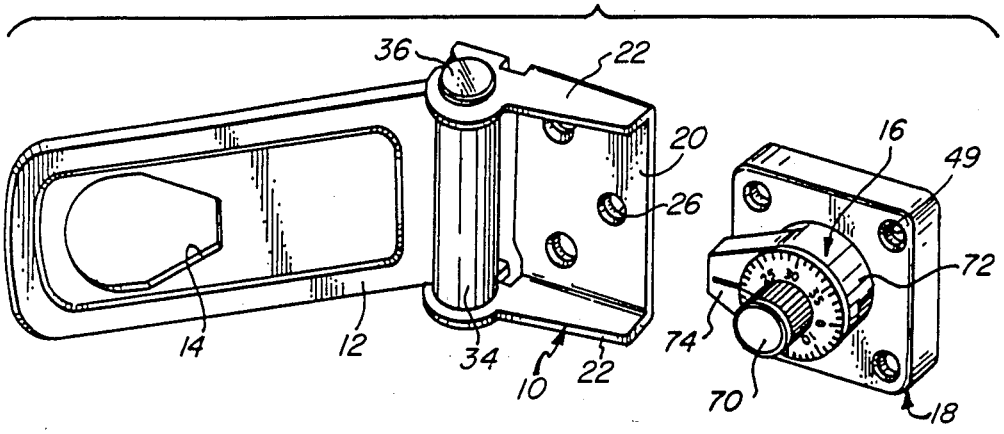
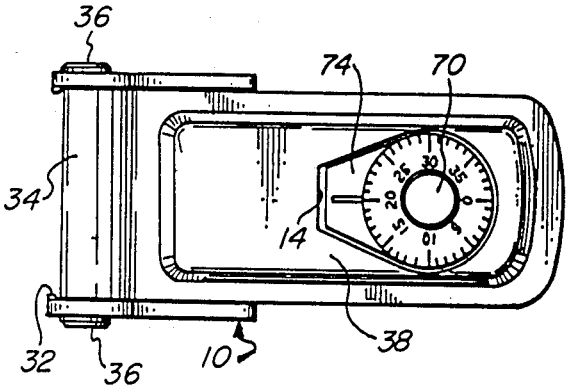
FIG. 2
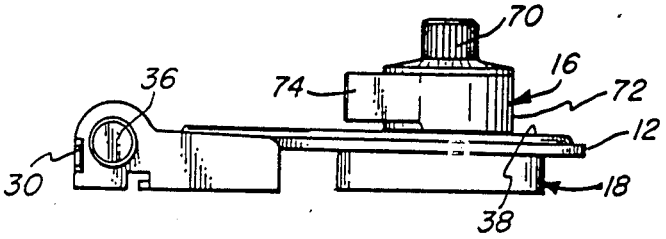
FIG. 3
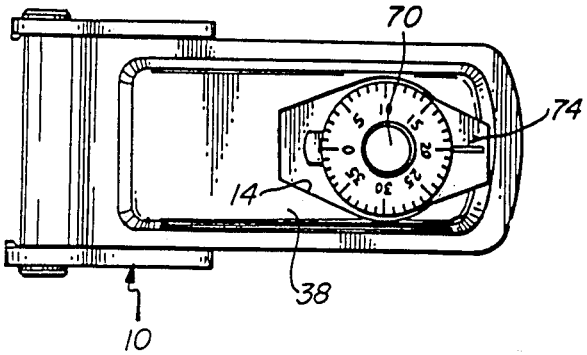
FIG. 4

FIG. 5
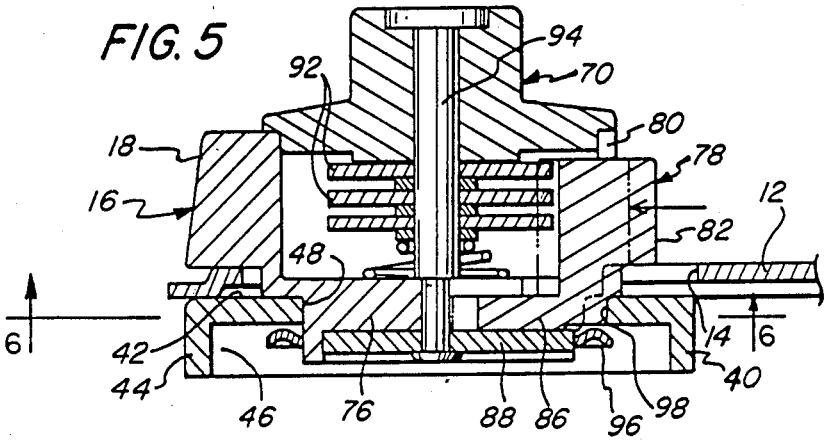
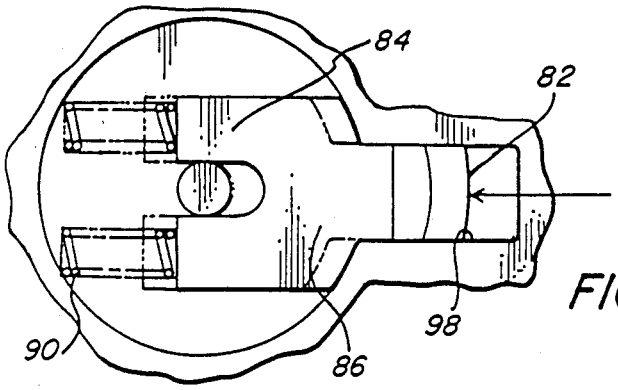
FIG. 6

HASP-TYPE LATCH WITH COMBINATION LOCK

CROSS-REFERENCE TO RELATED APPLICATION

The present invention is a continuation-in-part of Application Ser. No. 016,273 filed Feb. 19, 1987.

BACKGROUND OF THE INVENTION

Latches of the hasp type have been widely employed in connection with industrial doors, gates and various other structures where a relatively strong, but relatively low cost latching assembly is desired to retain a door or gate in a closed position. Frequently such hasp-type latches will include a staple with a formed wire element providing a U-shaped structure which is intended to receive the shackle of a key lock or combination lock to hold the latch arm in a position therebelow and against the staple base.

In recent years, efforts have been made to improve the appearance of such latches, and also to provide greater strength. In some instances, cast structures have been used to provide the staple member. It has also been proposed to employ staple members which would have a post that is rotatable on the base and have a portion which overlies the latch arm in its closed position to act at least as a latching mechanism to hold the latch arm in closed position. One problem with such hasps has been the tendency for separate locks utilized in connection with the hasps to fall to the ground, be lost, or be stolen, while the latch is in the open position.

It is an object of the present invention to provide a novel hasp-type latch provided with a unitary combination lock on the staple.

It is also an object to provide such a latch which may be readily fabricated and which is durable, attractive, and simple to operate.

SUMMARY OF THE INVENTION

It has now been found that the foregoing and related objects may be readily attained in a hasp-type latch which includes a hasp member having a pad with an elongated leaf having one end portion pivotably mounted on the pad and having an aperture therethrough adjacent its other end. A staple member has a base with a top wall and a depending sidewall defining a cavity thereunder, and the top wall has an opening therethrough. A post member has a pedestal portion extending through the opening into the cavity and a post portion extending above the top wall and through the aperature in the leaf in the closed position thereof. The pedestal portion has securing means thereon in the cavity extending beyond the opening to prevent it from being pulled through the opening in the top wall, and the post member is rotatable on the base. The aperture in the leaf is elongated, and the post portion is elongated and dimensioned and configured to extend through the aperture in the leaf in a first position wherein its elongate axis extends parallel to that of the aperture in the leaf and to overlie a portion of the leaf about the aperture when rotated into a second portion. Releasable latch means is provided on the post portion engageable with the base member to prevent rotation of said post portion from its second position to its first position. Combination lock means on the post member is releasably engageable with the latch means to preclude its release from engagement with the base member in the second position.

Preferably, the latch means comprises an extensible element on the post portion engageable in a recess in the base member to effect the prevention of rotation.

Desirably, this is a dog movable to engage in a recess in the base to prevent rotation of the post portion, and the dog is movable upon operation of the lock to its releasing position. An actuator element extends upwardly from the dog and above the base for manipulation, and the actuator element is movable radially inwardly of the post member to withdraw the dog from the recess. Desirably, the combination lock includes cam rings within the post member and rotatable by manipulation of the combination lock to a locking position in which they prevent the radially inward movement of the actuator element. The latch means may include means biasing the dog into its base engaging position.

BRIEF DESCRIPTION OF THE DRAWINGS

FIG. 1 is a perspective view of a hasp-type latch utilizing the combination lock staple member of the present invention and with the latch arm shown in the open position;

FIG. 2 is a top plan view thereof with the latch arm pivoted into the closed position;

FIG. 3 is a side elevational view thereof;

FIG. 4 is a plan view of the latch with the post member rotated 180° into the latching position;

FIG. 5 is a fragmentary sectional view of the staple end in the latched position of the post member of FIGS. 1–4 and drawn to an enlarged scale with the slide element shown in the locked position in full line; and FIG. 6 is a fragmentary, sectional view of the pedestal portion and slide element of FIG. 5 along the section line 6–6 thereof.

DETAILED DESCRIPTION OF THE ILLUSTRATED EMBODIMENTS

The latch of the present invention is comprised of the hasp member generally designated by the numeral 10 having an elongated latch arm 12 with an aperture 14 adjacent its free end through which extends the post member generally designated by the numeral 16 of the staple member generally designated by the numeral 18.

The hasp member 10 has a base wall 20 and upstanding side walls 22 extending along its side margins parallel to the arm 12. At one end, the side walls 22 are of greater height and have apertures formed therein. The base wall 20 is truncated or terminated adjacent the enlarged portion of the side walls 22, and it is provided with a multiplicity of mounting apertures 26 extending therethrough for screws (not shown) to mount it upon the mounting surface (not shown).

The enlarged portions of the side walls 22 have staked portions 30 at their outer edges spaced upwardly from the plane of the base wall 20, and these provide inwardly extending, opposed detents 32 which will frictionally engage the arm 12 when it is pivoted into the open position shown in FIG. 1. This allows the user to secure the arm 12 in a non-interfering position.

The leaf 12 has its one end rolled to form a generally cylindrical barrel 34, and a pair of hinge pins 36 extend through the apertures in the side walls 22 and into the barrel 34 to pivotally mount it in the side walls 22.

The arm 12 is stamped to provide an enlongated, raised platform portion 38 which extends from adjacent the barrel 34 to adjacent its free end and provides both enhanced strength and improved appearance. The aperture 14 has an arcuate portion adjacent the face end of the hasp and a truncated triangular portion extending towards the barrel end.

Turning now to the staple member 18, it has a pad 40 with a top wall 42 and a depending sidewall 44 extending thereabout to define a cavity 46 therewithin. In the top wall 42 is an opening 48 through which the post member 16 extends. The top wall 42 also has mounting apertures 49 to seat screws (not shown) to secure the pad 40 to the mounting surface 28 (not shown).

The post member 16 includes a combination lock 70 which has a cylindrical portion 72 and a laterally projecting upper portion 74 extending above the arm 12, as best seen in FIG. 3. The aperture 14 in the arm 12 is cooperatively dimensioned and configured to pivot downwardly over the post member 16 in the unlocked position.

As seen in FIG. 5, the pedestal portion 76 extends into the cavity 46 and the post member 16 has a slide element generally designated by the numeral 78 slidably seated in a slot 80 along one side thereof with a finger portion 82 projecting outwardly of the slot 80 for finger actuation and a pair of toes 84 on the bifurcated foot portion 86. The outer portion of the slide element 78 is configured to be above the plane of the arm 12 in its closed position so as not to interfere with latching and unlatching action, and the foot portion 86 slides on the washer 88.

The slide element 78 is biased outwardly by springs 90 as seen in FIG. 6 and is retained in assembly by the capture of its lower portion in the slot 80 and inside the opening 48 of the pad 40. The washer 88, combination lock 70 and its cam rings 92 are held in assembly by the pin 94, and the staple member 18 is secured in assembly on the pad 40 by the lock ring 96.

In accordance with conventional construction, the several cam rings 92 of the combination lock 70 may be rotated to bring them into the proper position determined by the present combination. In the illustrated latch, they have aligned notches (not shown) in their periphery which are aligned with a vertically extending shoulder on the slide element 78. At this point, the slide element 78 may be pushed inwardly into the notches in the cam rings against the pressure of the springs 90 to move the slide element 78 form the notch 98 in the top wall 42, thus allowing rotation of the post member 16 into the unlatched position seen in FIGS. 1–3.

In operation of this embodiment, the arm 12 is pivoted over the post member 16 while it is oriented in the position seen in FIG. 1. Thereafter, the post member 16 is rotated 180° to the position seen in FIGS. 4 and 5 at which time the springs 90 bias the slide element 78 outwardly into the notch 98 in the top wall 42. Rotating the combination lock knob 70 will now displace the cam rings 92 to preclude the slide element 78 from being pushed to disengage it from the slot 98. When it is desired to unlock the latch, the combination lock 70 is rotated to align the slots in the cam rings 92 with the slide element 78 so that it may be pressed inwardly to unseat it from the notch 98 and allow rotation of the post member 16.

Thus, it can be seen that the hasp-type latches of the present invention may be readily fabricated and at relatively low cost. They employ an integral combination lock which may be fabricated from commercially available components. The resultant structure is attractive, durable and relatively secure.

Having thus described the invention, what is claimed is:

1. A hasp-type latch comprising:

(a) a hasp member having: a pad and an elongated leaf having one end portion pivotably mounted on said pad and having an aperture therethrough adjacent its other end;

(b) a staple member having:

(i) a base with a top wall and a depending sidewall defining a cavity thereunder, said top wall having an opening therethrough; and (ii) a post member with a pedestal portion extending through said opening into said cavity and a post portion extending above said top wall and through said aperture in said leaf in said closed position thereof, said pedestal portion having securing means thereon in said cavity extending beyond said opening to prevent it from being pulled through said opening in said top wall, said post member being rotatable on said base, said aperture in said leaf being elongated, said post portion being elongated and dimensioned and configured to extend through said aperture in said leaf in a first position wherein its elongate axis extends parallel to that of said aperture in said leaf and to overlie a portion of said leaf about said aperture when rotated into a second position;

(iii) releasable latch means on said post portion engageable with said base to prevent rotation of said post portion from its second position to said first position; and (iv) combination lock means on said post member releasably engageable with said latch means to preclude its release from engagement with said base in said second position.

2. The latch in accordance with claim 1 wherein said latch means comprises an extensible element on said post portion engageable in a recess in said base to effect said prevention of rotation.

3. The latch in accordance with claim 2 wherein said latch means comprises a dog movable to engage in a recess in said base to prevent rotation of said post portion, said dog being movable upon operation of said lock means to its releasing position.

4. The latch in accordance with claim 3 wherein an actuator element extends upwardly from said dog and above said base for manipulation, said actuator element being movable radially inwardly with respect to said post member to withdraw said dog from said recess.

5. The latch in accordance with claim 4 wherein said combination lock means includes cam rings within said post member and rotatable by manipulation of the combination lock means to a locking position in which they prevent the radially inward movement of said actuator element.

6. The latch in accordance with claim 4 wherein said latch means includes means biasing said dog into its base engaging position.

* * * * *